US007878619B2

(12) United States Patent
Harada

(10) Patent No.: US 7,878,619 B2
(45) Date of Patent: Feb. 1, 2011

(54) MAINTENANCE METHOD OF FLUID EJECTING APPARATUS

(75) Inventor: Shuhei Harada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 101 days.

(21) Appl. No.: 12/370,822

(22) Filed: Feb. 13, 2009

(65) Prior Publication Data

US 2009/0207206 A1 Aug. 20, 2009

(30) Foreign Application Priority Data

Feb. 14, 2008 (JP) ..... 2008-033239

(51) Int. Cl.
*B41J 2/165* (2006.01)

(52) U.S. Cl. ..... 347/29; 347/32

(58) Field of Classification Search ..... 347/29, 347/30, 32, 23
See application file for complete search history.

(56) References Cited

U.S. PATENT DOCUMENTS 5,670,997 A * 9/1997 Sugimoto et al. ..... 347/30
6,010,203 A * 1/2000 Muraki ..... 347/30
7,014,291 B2 * 3/2006 Ishikawa ..... 347/29

FOREIGN PATENT DOCUMENTS

| | | |
|---|---|---|
| JP | 2002-011864 | 1/2002 |
| JP | 2004-195760 | 7/2004 |
| JP | 2007-021783 | 2/2007 |
| JP | 2007-038566 | 2/2007 |
| JP | 2007-062349 | 3/2007 |
| JP | 2008-120050 | 5/2008 |

* cited by examiner

*Primary Examiner*—Shih-wen Hsieh
(74) *Attorney, Agent, or Firm*—Workman Nydegger

(57) ABSTRACT

A maintenance method of a fluid ejecting apparatus having a fluid ejection head. A cap member faces an ejection region of the ejection head and a portion thereof facing the ejection region covers a space that includes the ejection surface. When the space covered by the cap member is to be uncovered, the facing portion of the cap member is tilted with respect to the ejection head. Fluid is then ejected from a first portion of the ejection region toward a predetermined region of the facing portion. The ejection head is then moved, and a second portion of the ejection region behind the first portion is positioned so as to overlap the predetermined region in a plan view. Fluid is then ejected from the second portion toward the predetermined region, and the potential difference resulting from the ejection of the fluid from the ejection head is detected.

5 Claims, 11 Drawing Sheets

MAINTENANCE METHOD OF FLUID EJECTING APPARATUS

CROSS-REFERENCE TO RELATED APPLICATIONS

This application claims priority under the Paris Convention based on Japanese Patent Application No. 2008-33239 (filed on Feb. 14, 2008),

BACKGROUND

1. Technical Field

The present invention relates to a maintenance method of a fluid ejecting apparatus.

2. Related Art

As a fluid ejecting apparatus for ejecting fluid, for example, an ink jet recording apparatus is known. The ink jet recording apparatus is an apparatus for recording letters, images, etc., on a medium and is configured to eject ink from nozzles provided in a recording head (ejection head) onto a medium. The ink jet recording apparatus has a cap member for preventing the inside of the nozzles from drying or preventing dust from entering the nozzles (for example, refer to Japanese Unexamined Patent Application Publication No. 2002-11864). In recent years, a technique in which an electrode is provided on the cap member to detect a potential difference between the cap member and the head after ink is ejected from the nozzles onto the cap member to automatically detect a missing dot of the nozzles is proposed.

The cap member has a suction mechanism that depressurizes a capped space to suck the ink from the nozzles. After the cap member is fitted to the head to perform a suction operation or the like, a negative pressure is usually created in the space covered by the cap. When the cap member is to be separated from the head in this state, if they are separated while a contact portion of the cap member and an ejection surface of the head are parallel to each other, the cap member may be suddenly separated from the head, causing ink to be scattered and deposited on the ejection surface. Therefore, they are separated from an end of the contact portion such that the contact portion of the cap member is tilted with respect to the ejection surface of the head. When the cap member is separated from the head in this manner, the cap member is often kept tilted with respect to the ejection surface of the head.

However, if the cap member is tilted with respect to the ejection surface, the distance between the electrode on the cap member and the ejection surface varies depending on the location of the electrode, which causes measurement noise when the potential difference between them is measured. Thus, precise detection of a missing dot of the nozzles becomes difficult.

SUMMARY

An advantage of some aspects of the invention is that it provides a maintenance method of a fluid ejecting apparatus capable of precise detection of a missing dot of an ejection head.

A maintenance method of a fluid ejecting apparatus having an ejection head that is movable in a predetermined direction and ejects fluid onto a medium; a cap member that faces an ejection region of the ejection head, a portion facing the ejection region being tiltable with respect to the ejection head, and that comes into contact with an ejection surface of the ejection head for ejecting fluid so as to cover a space including the ejection surface; and a potential difference detection unit that detects a potential difference between the cap member and the ejection head, the maintenance method includes: when a capped state, in which the space is covered by the cap member, is to be terminated, terminating the capped state from a part of the cap member by tilting the facing portion of the cap member with respect to the ejection head; after termination of the capped state, ejecting fluid from a first portion of the ejection region toward a predetermined region of the facing portion; after ejection of the fluid from the first portion, moving the ejection head in the moving direction and positioning a second portion of the ejection region provided behind the first portion of the ejection region in the moving direction at a position overlapping the predetermined region in a plan view; after movement of the ejection head, ejecting fluid from the second portion toward the predetermined region; and detecting the potential difference resulting from the ejection of the fluid from the ejection head.

In the invention, while the facing portion of the cap member is tilted with respect to the ejection head, the fluid is ejected from the first portion of the ejection region toward the predetermined region of the facing portion. The ejection head is then moved in the moving direction and the second portion of the ejection region provided behind the first portion of the ejection region in the moving direction is positioned at a position overlapping the predetermined region in the plan view. Then, the fluid is ejected from the second portion toward the predetermined region, and the potential difference resulting from the ejection of the fluid from the ejection head is detected. Accordingly, the distance between the first portion that ejects fluid and the predetermined region of the cap member and the distance between the second portion that performs subsequent ejection and the predetermined region of the cap member can be made substantially the same. Therefore, even if the facing portion of the cap member is tilted, the potential difference can be measured accurately. Thus, precise detection of a missing dot of the ejection head becomes possible.

The "predetermined direction" may be the main scanning direction of the ejection head during ejection of fluid onto a medium. When the fluid ejecting apparatus separately has a medium position where the medium is disposed and a maintenance position where maintenance is performed on the ejection head, the "predetermined direction" may be a direction in which the ejection head reciprocates between the medium position and the maintenance position.

It is preferable that the "predetermined region" be an anterior region of the facing portion in the moving direction of the ejection head. It is more preferable that the "predetermined region" be an anteriormost region of the facing portion in the moving direction of the ejection head and a region where the potential difference detection unit can detect the potential difference.

In the above-described maintenance method of a fluid ejecting apparatus, the medium may be disposed in the moving direction of the ejection head with respect to the cap member.

According to the invention, because the medium is disposed in the moving direction of the ejection head, the potential difference can be detected while the ejection head is moved from a position above the cap member to a position where the medium is disposed. This enables efficient maintenance.

In the above-described maintenance method of a fluid ejecting apparatus, a plurality of nozzles for ejecting fluid may be provided in the ejection region, and the plurality of nozzles may be arranged in a direction perpendicular to the moving direction of the ejection head.

According to the invention, because the plurality of nozzles are arranged in the direction perpendicular to the moving direction of the ejection head, the distances between the facing portion and the respective nozzles are substantially the same even if the facing portion is tilted. Because this allows the arranged nozzles to eject ink simultaneously, the potential difference can be easily measured.

In the above-described maintenance method of a fluid ejecting apparatus, a plurality of rows of the nozzles may be provided at the first portion.

According to the invention, because the plurality of rows of the nozzles are provided at the first portion, measurement of the potential difference for the plurality of rows of the nozzles can be performed with a single movement. This improves the maintenance efficiency.

In the above-described maintenance method of a fluid ejecting apparatus, when the capped state is terminated, the facing portion may be tilted such that an anterior side of the facing portion of the cap member in the moving direction of the ejection head is closer to the ejection head.

According to the invention, because, when the capped state is terminated, the facing portion is tilted such that the anterior side of the facing portion of the cap member in the moving direction of the ejection head is closer to the ejection head, the distance between the cap member and the first and second portions can be made small. This suppresses measurement error of the potential difference.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
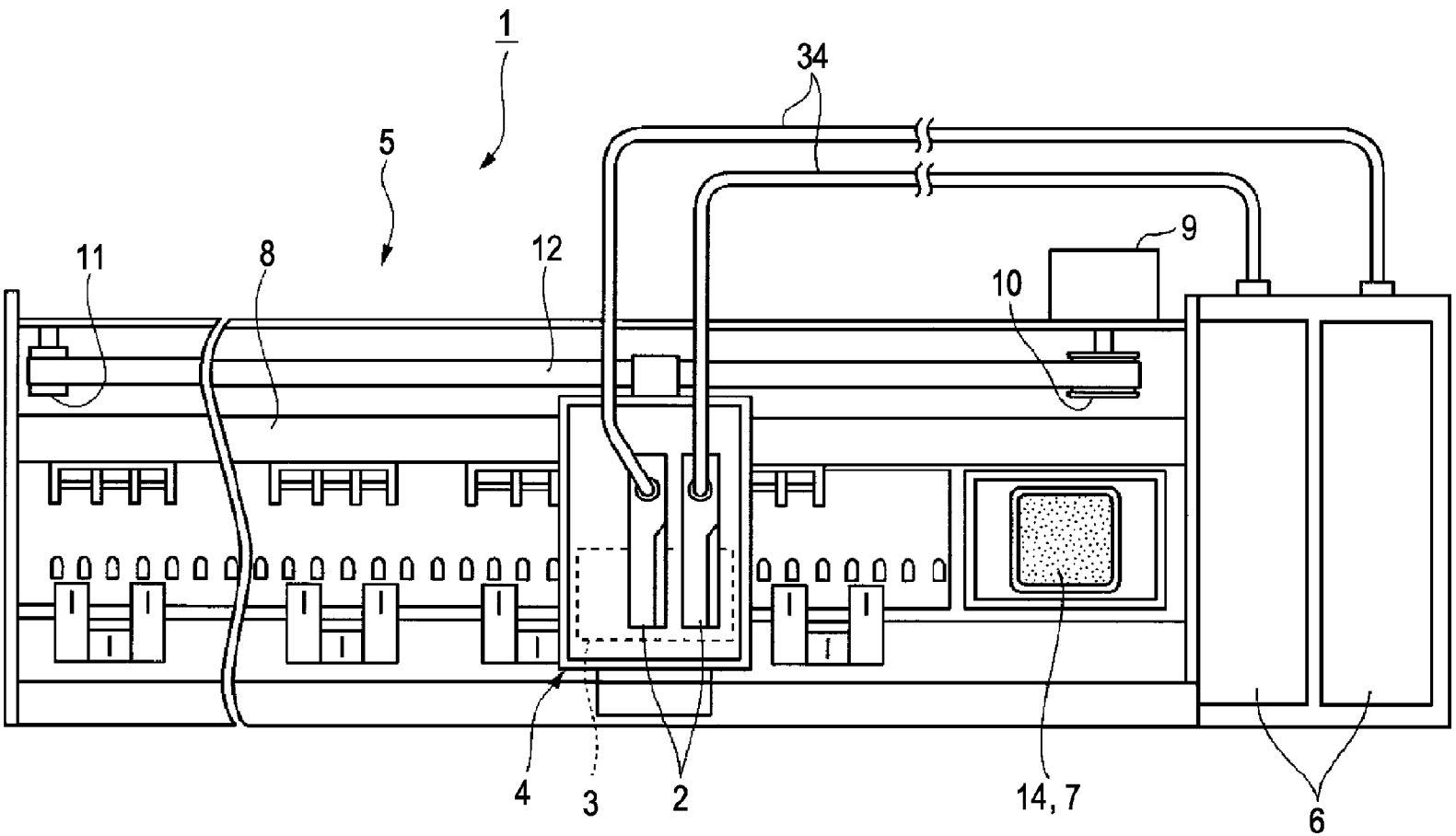
FIG. 1 is a partially exploded view showing a schematic configuration of a printer.

A cleaning method and an embodiment of a fluid ejecting apparatus of the invention will be described below with reference to the drawings. In this embodiment, as an example of the fluid ejecting apparatus of the invention, an ink jet printer (hereinafter referred to as "printer 1") is shown. FIG. 1 is a partially exploded view showing a schematic configuration of a printer according to an embodiment of the invention.

The printer 1 includes a carriage 4 carrying subtanks 2 and a recording head 3, and a printer body 5. The printer body 5 has a carriage moving mechanism 65 (refer to FIG. 7) for reciprocating the carriage 4, a sheet feeding mechanism 66 (refer to FIG. 7) for transporting recording paper (not shown and onto which fluid is ejected), a capping mechanism 14 used in cleaning of the recording head (ejection head) 3, and ink cartridges 6 containing ink to be supplied to the recording head 3.

The printer 1 also has an ink droplet sensor (fluid detecting portion) 7 (refer to FIGS. 4 and 7) capable of detecting ink droplets D discharged from the recording head 3. The ink droplet sensor 7 is capable of obtaining ink-discharging status of the nozzles by charging the ink droplets D discharged from the nozzles of the recording head 3 and by outputting a change in voltage due to the electrostatic induction during flying of the charged ink droplets D as a detection signal. A detailed description of the ink droplet sensor 7 will be given below.

The carriage moving mechanism 65 includes a guide shaft 8 extending in the width direction of the printer body 5 shown in FIG. 1, a pulse motor 9, a driving pulley 10 connected to a rotary shaft of the pulse motor 9 and rotated by the pulse motor 9, an idling pulley 11 disposed opposite to the driving pulley 10 in the width direction of the printer body 5, and a timing belt 12 which runs between the driving pulley 10 and the idling pulley 11 and is connected to the carriage 4.

By driving the pulse motor 9, the carriage 4 reciprocates along the guide shaft 8 in the main scanning direction. The sheet feeding mechanism 66 includes a sheet feed motor, a sheet feed roller rotated by the sheet feed motor, etc. (none of them are shown), and sequentially feeds the recording paper onto a platen 13 in conjunction with a recording (printing) operation.

Figure 2:
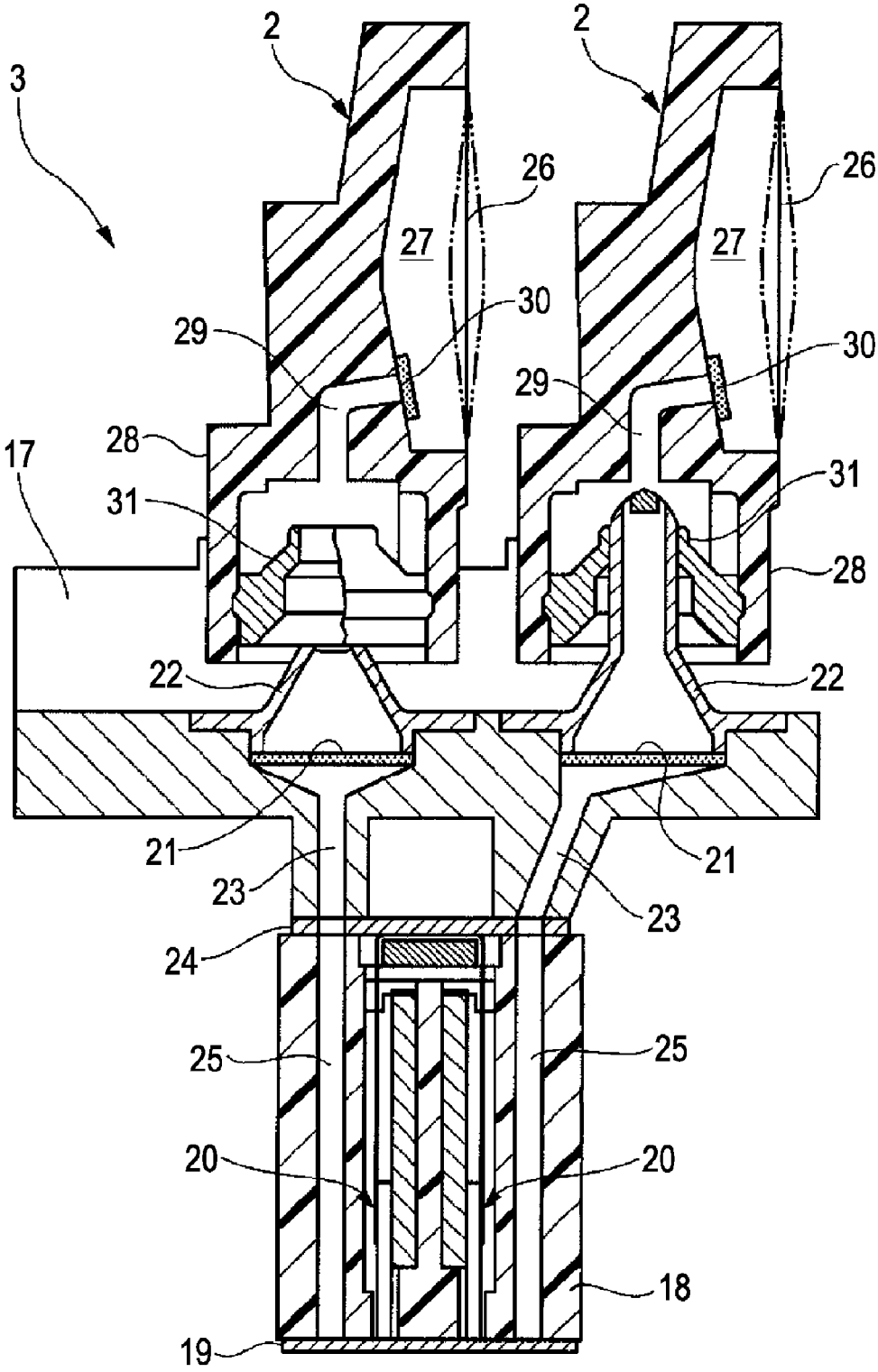
FIG. 2 is a sectional view showing a configuration of a recording head.
Figure 3:
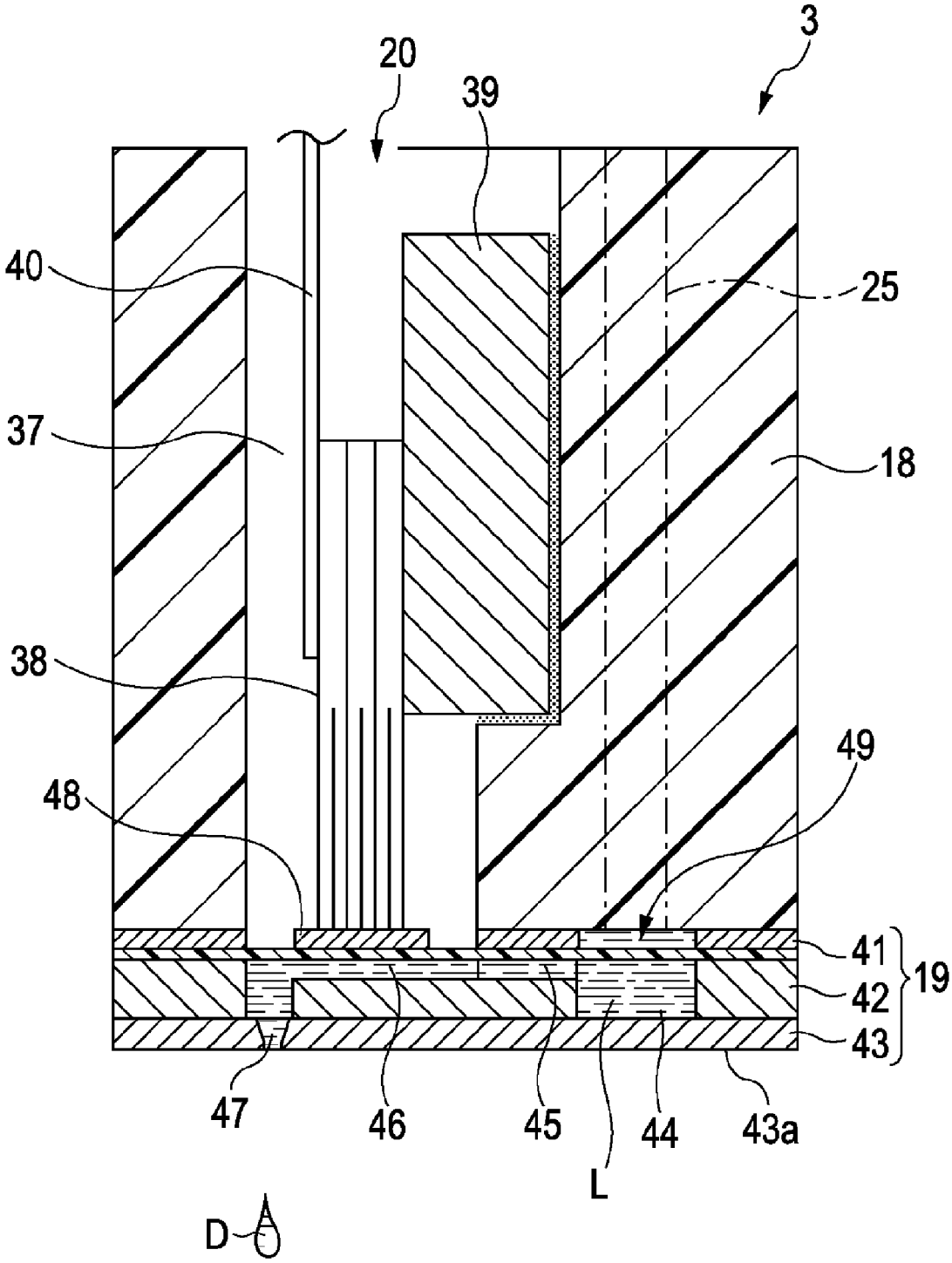
FIG. 3 is a sectional view of a relevant part showing a configuration of the recording head.
Figure 4:
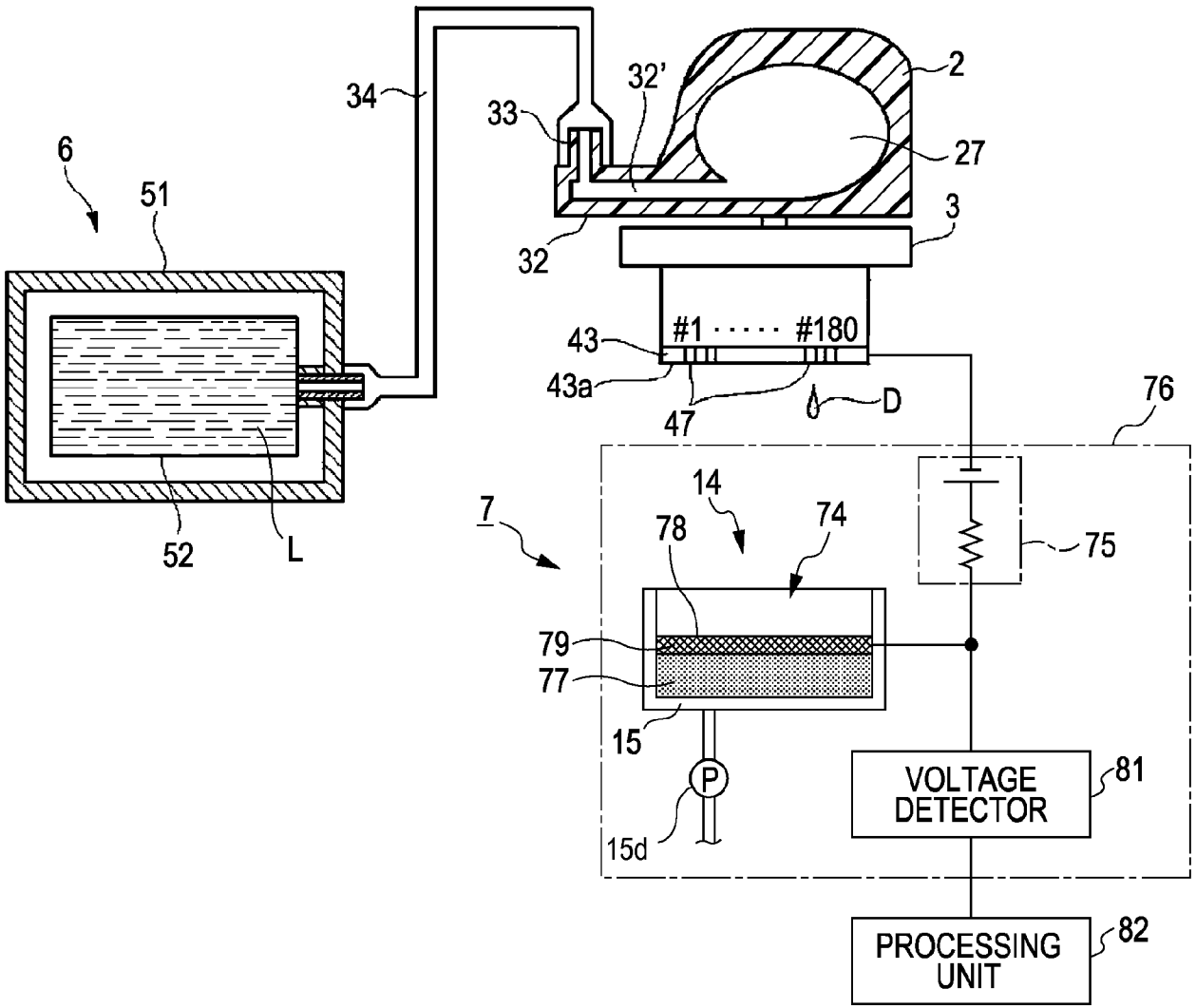
FIG. 4 is a schematic view showing a configuration of a relevant part around the recording head.

FIG. 2 is a sectional view showing a configuration of the recording head of the printer and FIG. 3 is a sectional view of a relevant part showing a configuration of the recording head. FIG. 4 is a schematic view showing a configuration of a relevant part around the recording head 3.

As shown in FIG. 2, the recording head 3 according to this embodiment consists mainly of a supply-needle unit 17, a head case 18, a flow path unit 19, and an actuator unit 20.

Two ink-supply needles 22 are attached side by side to the upper surface of the supply-needle unit 17 such that a filter 21 is disposed between each ink-supply needle 22 and the upper surface of the supply-needle unit 17. The subtanks 2 are attached to these ink-supply needles 22. Ink-supply paths 23 corresponding to the ink-supply needles 22 are formed in the supply-needle unit 17.

The upper ends of these ink-supply paths 23 communicate with the ink-supply needles 22 through the filters 21 and the lower ends thereof communicate with case flow paths 25 formed in the head case 18 through a gasket 24.

Although two subtanks 2 are disposed since this embodiment is configured to use two types of ink, the invention is of course applied to a configuration using three or more types of ink.

The subtanks 2 are formed of a resin such as polypropylene. These subtanks 2 have hollow portions serving as ink chambers 27. The ink chambers 27 are defined by attaching transparent elastic sheets 26 to the open surfaces of the hollow portions.

At the lower portions of the subtanks 2, needle-connection portions 28, into which the ink-supply needles 22 are inserted are formed so as to extend downward. The ink chambers 27 in the subtanks 2 are shallow cone-shaped. An upper opening of a connecting flow path 29 communicating with the needle-connection portion 28 is provided in a side surface of each ink chamber 27 at a position slightly below the midpoint in the top-bottom direction. A tank portion filter 30 for filtering ink L is attached to the upper opening. Seal members 31 for sealing the ink-supply needles 22 in a liquid-tight manner are fitted into the inner spaces of the needle-connection portions 28.

As shown in FIG. 4, the subtanks 2 each have an elongated portion 32 that has a communication groove 32' communicating with the ink chamber 27. An ink inlet port 33 is formed so as to be projected from the upper surface of the elongated portion 32. An ink-supply tube 34 for supplying the ink L stored in the ink cartridge 6 is connected to the ink inlet port 33. Thus, the ink L having passed through the ink-supply tube 34 flows from the ink inlet port 33, through the communication groove 32', and into the ink chamber 27.

The elastic sheets 26 shown in FIG. 2 can be deformed in directions in which the ink chambers 27 are contracted and expanded. The elastic sheets 26 perform a damper function and absorb the pressure fluctuation of the ink L. In other words, the action of the elastic sheets 26 makes the subtanks 2 serve as pressure dampers. Accordingly, the ink L is supplied to the recording head 3 after the pressure fluctuation is absorbed in the subtanks 2.

The head case 18 is a hollow box-shaped member made of a synthetic resin and is connected to the flow path unit 19 at the lower end surface. The head case 18 accommodates the actuator unit 20 in a storage cavity 37 formed therein. The supply-needle unit 17 is attached to the upper end surface of the head case 18, opposite to the flow path unit 19, with the gasket 24 interposed therebetween.

The case flow paths 25 penetrating the head case 18 in the height direction are formed in the head case 18. The upper ends of the case flow paths 25 communicate with the ink-supply paths 23 of the supply-needle unit 17 through the gasket 24.

The lower ends of the case flow paths 25 communicate with common ink chambers 44 in the flow path unit 19. Thus, the ink L introduced from the ink-supply needles 22 is supplied to the common ink chambers 44 through the ink-supply paths 23 and the case flow paths 25.

As shown in FIG. 3, the actuator unit 20 accommodated in the storage cavity 37 of the head case 18 includes a plurality of piezoelectric vibrators 38 arranged in an interdigital configuration, a fixed plate 39 to which the piezoelectric vibrators 38 are bonded, and a flexible cable 40 serving as a wiring member for supplying driving signals from the printer body to the piezoelectric vibrators 38. The piezoelectric vibrators 38 are bonded to the fixed plate 39 at the fixing end and are projected outward from the top surface of the fixed plate 39 at the free end. That is, the piezoelectric vibrators 38 are attached in a cantilever manner to the fixed plate 39.

The fixed plate 39 supporting the piezoelectric vibrators 38 is made of, for example, a stainless steel plate having a thickness of about 1 mm. The actuator unit 20 is accommodated in and fixed to the storage cavity 37 by bonding the back surface of the fixed plate 39 to an inside wall of the case defining the storage cavity 37.

The flow path unit 19 is formed by stacking flow-path-unit forming members including a vibration plate (sealing plate) 41, a flow path substrate 42, and a nozzle substrate 43, and integrally bonding them with an adhesive. The flow path unit 19 forms ink flow paths (liquid flow paths) each extending from the common ink chamber 44 through an ink supply port 45 and a pressure chamber 46 to the nozzles 47. The pressure chamber 46 is formed as an elongated chamber extending in a direction perpendicular to the direction in which the nozzles 47 are arranged (nozzle row direction). The common ink chambers 44 communicate with the case flow paths 25, and the ink L from the ink-supply needles 22 is introduced into the common ink chambers 44.

The ink L introduced into the common ink chambers 44 is distributed to the pressure chambers 46 through the ink supply ports 45.

The nozzle substrate 43 disposed at the bottom of the flow path unit 19 is a thin metal plate having the plurality of nozzles 47 arranged in rows at a pitch according to the dot-forming density (for example, 180 dpi). The nozzle substrate 43 according to this embodiment is formed of a stainless steel plate and has, for each of the subtanks 2, a total of eight rows of the nozzles 47 (i.e., nozzle rows) arranged in parallel. Each nozzle row includes, for example, 180 nozzles 47. The flow path substrate 42 disposed between the nozzle substrate 43 and the vibration plate 41 is a plate-like member in which flow path portions serving as the ink flow paths, more specifically, cavities serving as the common ink chambers 44, the ink supply ports 45 and the pressure chambers 46 are defined.

In this embodiment, the flow path substrate 42 is formed by anisotropically etching a silicon wafer, a base material having crystallinity. The vibration plate 41 is a two-layer composite plate formed of a supporting plate made of a metal, such as stainless steel, laminated with an elastic film. An island portion 48 to which the top surfaces of the piezoelectric vibrators 38 are bonded is formed in the vibration plate 41, at a portion corresponding to the pressure chamber 46, by removing a circular portion from the supporting plate by etching or the like. The island portion 48 serves as a diaphragm portion. That is, the vibration plate 41 is configured such that the elastic film around the island portion 48 is elastically deformed in response to the operation of the piezoelectric vibrators 38. The vibration plate 41 seals an open surface of the flow path substrate 42 and serves also as a compliance portion 49. Similarly to the diaphragm portion, the portion corresponding to the compliance portion 49 is made only of the elastic film by removing the supporting plate by etching or the like.

In the recording head 3, when a driving signal is supplied to the piezoelectric vibrators 38 through the flexible cable 40, the piezoelectric vibrators 38 expand and contract in the longitudinal direction of the vibrators, which causes the island portion 48 to move toward or away from the pressure chamber 46. This varies the volume of the pressure chamber 46, causing pressure fluctuations of the ink L in the pressure chamber 46. The pressure fluctuations cause the ink droplets D to be discharged from the nozzles 47.

As shown in FIG. 4, the ink cartridges 6 each include a hollow box-shaped case member 51 and an ink pack 52 formed of a plastic material. The ink pack 52 is accommodated in an accommodating chamber of the case member 51.

The ink cartridges 6 each communicate with an end of the ink-supply tube 34 and supplies the ink L in the ink pack 52 to the recording head 3, utilizing the water head difference from the nozzle open surface 43*a* of the recording head 3. More specifically, the relative positional relationship in the gravity direction between the ink cartridges 6 and the recording head 3 is set such that a slight negative pressure is applied to the menisci at the nozzles 47.

Pressure fluctuations caused by driving the piezoelectric vibrators 38 allows the ink L to be supplied to the pressure chamber 46 and, as described above, allows the ink droplets D to be discharged from the nozzles 47.

Figure 9:
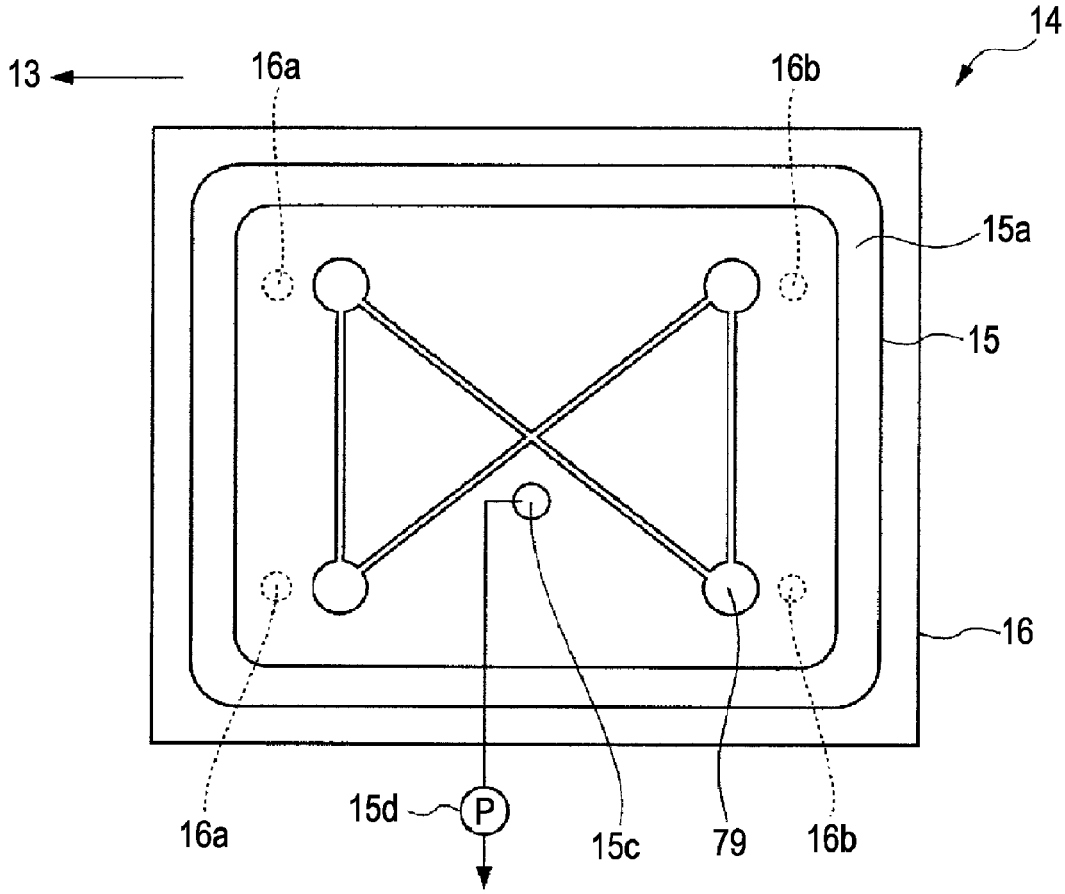
FIG. 9 is a plan view showing a configuration of a maintenance mechanism of the printer.
Figure 10:
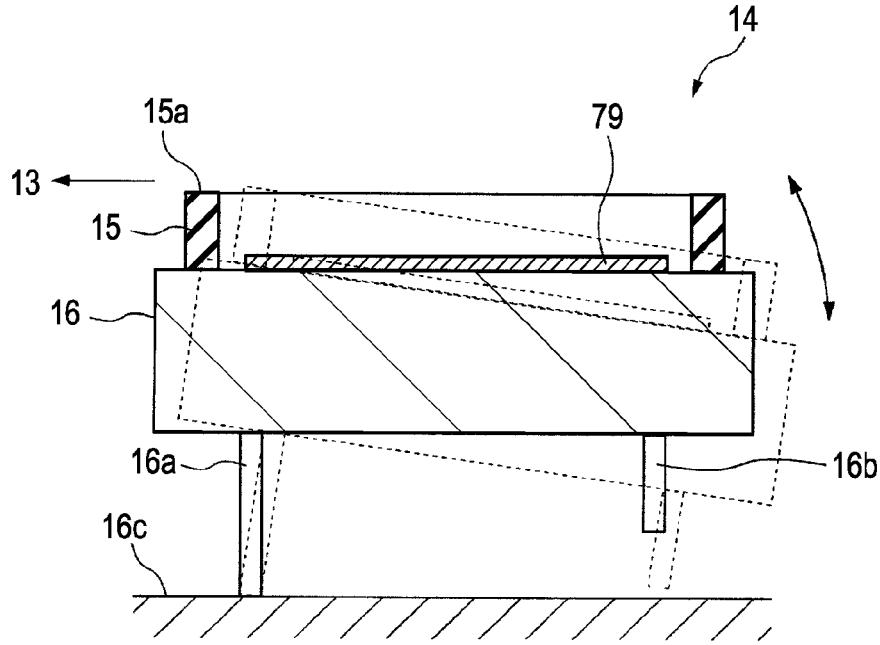
FIG. 10 is a sectional view showing a configuration of the maintenance mechanism.

The capping mechanism 14 includes, as shown in FIGS. 4, 9, and 10, a cap member 15, a supporting member 16, and an electrode 79. FIG. 9 is a plan view showing a configuration of the capping mechanism 14 and FIG. 10 is a sectional view showing a configuration of the capping mechanism 14. In FIGS. 9 and 10, the platen 13 is provided on the left side of the drawings.

As shown in FIGS. 9 and 10, the cap member 15 consists of a member made of an elastic material such as rubber formed in the shape of a tray, and is disposed on the supporting member 16 located at a home position. The home position is a position provided at an end region outside of the recording region and within the moving range of the carriage 4. The carriage 4 is located at the home position when cleaning is performed on the recording head 3. As shown in FIGS. 9 and 10, the supporting member 16 has supporting rods 16*a* and supporting rods 16*b*. The supporting rods 16*a* are provided near the two corners adjacent to the platen 13, among the four corners of the supporting member 16. The supporting rods 16*b* are provided near the two corners farthest from the platen 13 (the right side in FIGS. 9 and 10), among the four corners of the supporting member 16. The supporting rods 16*a* are longer than the supporting rods 16*b*, and the lower ends of the supporting rods 16*a* are in contact with a supporting surface 16*c*. Clearances of a length equivalent to the difference in length between the supporting rods 16*a* and the supporting rods 16*b* are formed between the supporting surface 16*c* and the lower ends of the supporting rod 16*b*. When a downward force is applied to the supporting member 16 at a right side portion in FIGS. 9 and 10 from above, the supporting member 16 is rotated about the fulcrum, i.e., the lower ends of the supporting rods 16*a*, by an amount equivalent to the clearances formed between the supporting surface 16*c* and the supporting rods 16*b*. As a result of the supporting member 16 being rotated in this manner, the supporting member 16 is tilted. It is more preferable that one of the supporting rods 16*b* be shorter than the other so that the supporting member 16 is tilted toward one of the four corners of the cap member 15.

Cleaning of the recording head 3 is performed when the carriage 4 is located at the home position and the cap member 15 is in contact with and seals the surface of the nozzle substrate 43 of the recording head 3 (i.e., the nozzle open surface 43*a*). In this embodiment, cleaning refers to forced discharging of ink from the nozzles 47 in the recording head 3, which is processing for maintaining or recovering the discharge property of the head.

More specifically, during cleaning, the inside of the cap member 15 (sealed cavity) is depressurized by activating the suction mechanism 15*d* in a sealed state. Thus, the ink L in the recording head 3 is forcedly discharged as ink droplets from the nozzles 47.

The printer 1 according to this embodiment performs cleaning for recovering or maintaining the ejection property of the nozzles 47 in the ejection head several times in order to obtain a stable ink ejection property.

Cleaning includes detecting ink ejection status of the nozzles 47, determining cleaning parameters for cleaning of the recording head 3 (parameters for the suction operation) according to the detection result, and performing cleaning (suction operation) on the recording head 3 according to the processing parameters.

In detecting ink ejection status and determining cleaning parameters, the ink droplet sensor 7 is used. As shown in a flow to be described below, when a nozzle suffering from discharge failure (hereinafter also referred to as a "defective nozzle") is detected as a result of the detection, the printer 1 performs cleaning.

In the printer 1, before the power is turned on (in a power-OFF state), the carriage 4 is located at the home position and the cap member 15 is in contact with and seals the surface of the nozzle substrate 43 of the recording head 3. Thus, drying of the ink L in the nozzles 47 due to the air is prevented. However, when the printer 1 is kept in the power-OFF state for a long time, the ink L gradually dries and becomes viscous, which may cause discharge failure. Thus, the printer 1 according to this embodiment performs cleaning upon the initial drive of the recording head 3, that is, when the printer 1 is turned on, to recover the printing quality before carrying out a printing operation. The printer 1 according to this embodiment seeks an improvement in printing quality by performing cleaning not only upon the initial drive, but also upon the initial ink filling and after replacement of the ink cartridges 6 (auto cleaning). The cleaning according to this embodiment includes not only auto cleaning that is automatically conducted according to the above-described predetermined conditions but also manual cleaning that is conducted upon an instruction by a user.

Ink Droplet Sensor 7

The ink droplet sensor 7 shown in FIG. 4 has a detecting portion 78 disposed so as to face the nozzle open surface 43*a* of the recording head 3 with a predetermined gap therebetween, the ink discharged from the nozzles 47 being supplied to the detecting portion 78, a detecting unit 76 capable of detecting ink discharge status in the respective the nozzles 47 by outputting detection waveforms according to ink discharged from the nozzles 47, and a processing unit 82 that obtains information related to the weight of the ink from the detection waveforms output from the detecting unit 76. The processing unit 82 has a function to determine parameters for cleaning according to the detection result of the detecting unit 76, as described below in detail.

The detecting unit 76 has a voltage applicator 75 for applying a voltage between the detecting portion 78 and the nozzle open surface 43*a* of the recording head 3 and a voltage detector 81 for detecting the voltage of the detecting portion 78. In this embodiment, as described above, the detecting portion 78 of the detecting unit 76 is provided in the cap member 15 located at the home position.

The cap member 15 is an open-top tray-shaped member made of an elastic member such as elastomer. An ink absorber 77 and an electrode member 79 are disposed in the cap member 15. The electrode member 79 is made of a mesh member composed of a metal, such as stainless steel. The upper surface of the electrode member 79 constitutes the detecting portion 78. The detecting portion 78 is disposed at a position lower than the upper end surface of the cap member 15.

The ink absorber 77 is made of a sponge-like member or a porous member capable of retaining (absorbing) the ink L. In this embodiment, the ink absorber 77 is made of a nonwoven fabric such as felt. For example, while recording is not performed, the ink absorbed by the ink absorber 77 moisturizes the space formed by the nozzle open surface 43*a* and the cap member 15 in contact with each other and thereby suppresses drying of the ink in the nozzles 47.

The ink droplets D landed on the detecting portion 78 pass through the gaps in the lattice-like electrode member 79 to be retained (absorbed) by the ink absorber 77 disposed therebeneath. The electrode member 79 does not need to be a mesh member as long as it allows the ink droplets D to pass therethrough. If there is no ink absorber 77, the electrode member 79 is held by a rib extending from the bottom surface of the cap member 15. As described above, a tube (not shown) is connected to the bottom of the cap member 15, through which the ink droplets D in the ink absorber 77 are sucked by the suction mechanism 15*d* and discharged to the outside.

The voltage applicator 75 includes an electronic circuit capable of applying a voltage between the ejection surface (nozzle open surface 43*a*) of the nozzle substrate 43 of the recording head 3 and the detecting portion (upper surface) 78 of the electrode member 79. In this embodiment, the voltage applicator 75 electrically connects the electrode member 79 and the nozzle substrate 43, via a direct-current power supply and a resistance element, in a manner that the electrode member 79 serves as the positive pole and the nozzle substrate 43 serves as the negative pole.

As described above, the nozzle substrate 43 and the electrode member 79 are made of a metal such as stainless steel and are conductive. That is, the voltage applicator 75 can apply a voltage between the nozzle open surface 43*a* and the detecting portion 78.

The voltage detector 81 includes an integrating circuit that integrates and outputs voltage signals of the electrode member 79, an inverting amplifier circuit that outputs the signal output from the integrating circuit after performing inverting amplification thereon, and an A/D converter circuit that outputs the signal output from the inverting amplifier circuit after performing A/D conversion thereon.

In this embodiment, the detecting unit 76 applies an electric field between the nozzle open surface 43*a* and the detecting portion 78 and outputs temporal change in voltage due to electrostatic induction during transfer of the ink from the nozzles 47 to the detecting portion 78 as a detection waveform to the processing unit 82. The processing unit 82 can perform arithmetic processing on the output of the detecting unit 76 and can obtain information related to the weight of the ink according to the detection waveform output from the detecting unit 76.

Figure 5A:
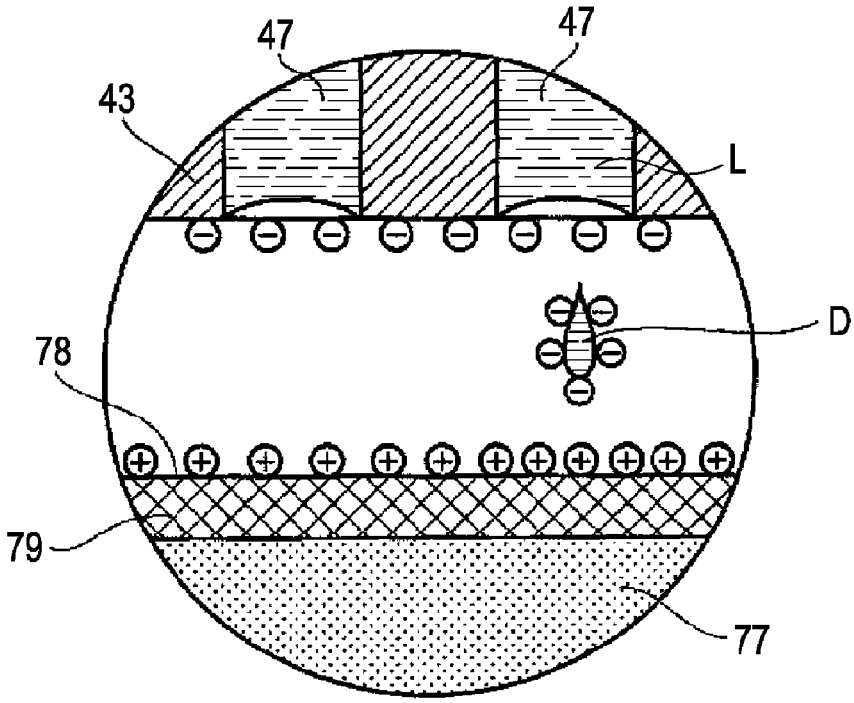
FIGS. 5A and 5B are schematic views illustrating a principle of generation of induced voltage by electrostatic induction.
Figure 5B:
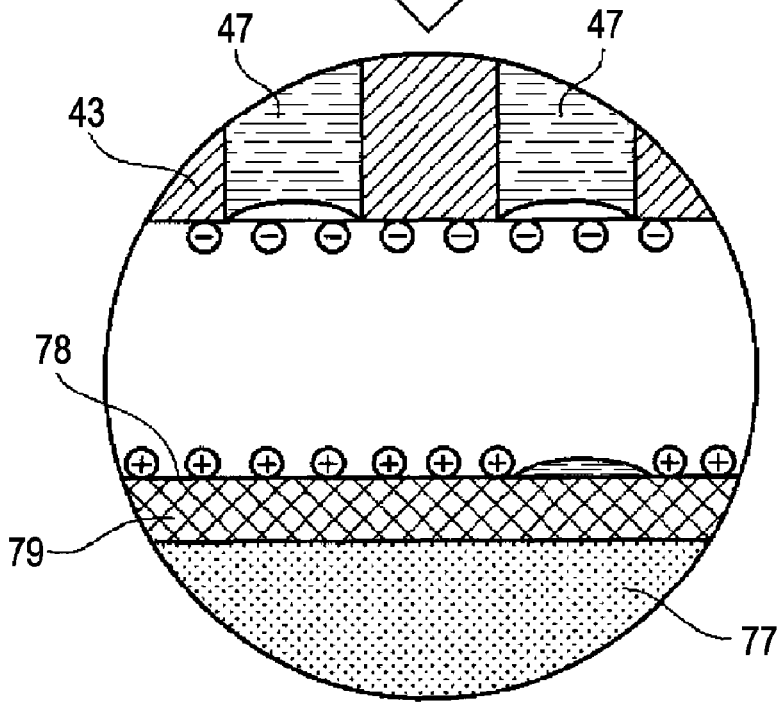
Figure 6:
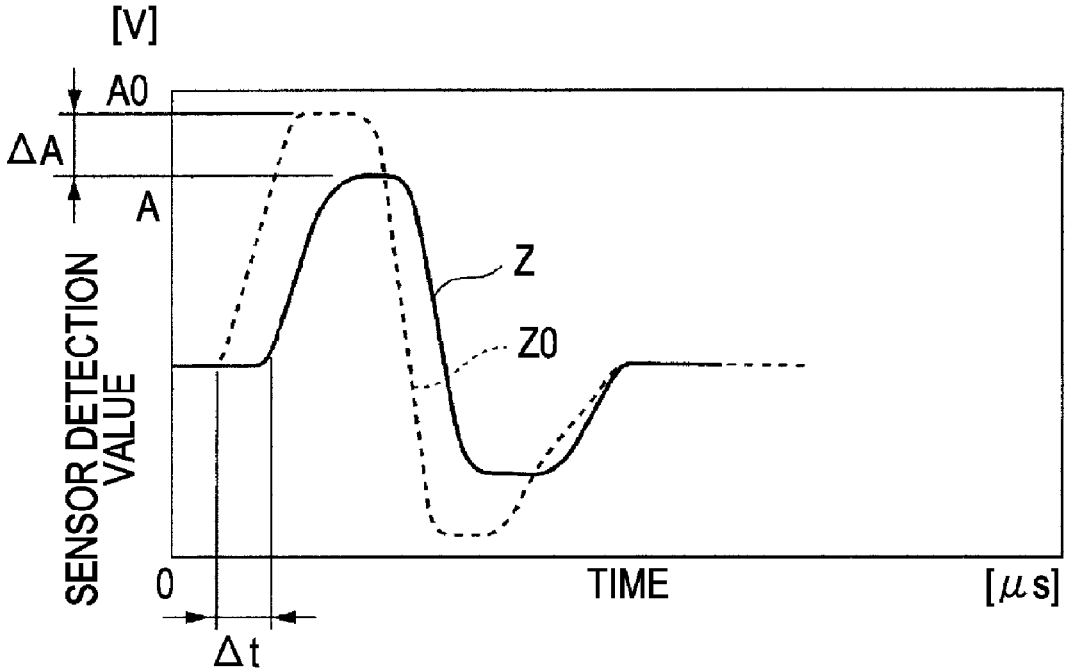
FIG. 6 is a diagram showing an example of a waveform of a detection signal output from an ink droplet sensor.

The principle of the ink droplet sensor 7, that is, the principle of generation of induced voltage by electrostatic induction, will be described with reference to the drawings. FIGS. 5A and 5B are schematic views illustrating a principle of generation of induced voltage by electrostatic induction. FIG. 5A shows the ink droplet D immediately after being discharged, and FIG. 5B shows the ink droplet D landed on an examination region 74 of the cap member 15. FIG. 6 shows an example of a waveform of a detection signal (for one ink droplet) output from the ink droplet sensor 7. While a voltage is applied between the nozzle substrate 43 and the electrode member 79, the piezoelectric vibrators 38 are actuated by a discharge pulse DP to discharge the ink droplet D from one of the nozzles 47.

At this time, because the nozzle substrate 43 is the negative pole, as shown in FIG. 5A, part of the negative charge of the nozzle substrate 43 transfers to the ink droplet D. Thus, the discharged ink droplet D is negatively charged. As the ink droplet D approaches the detecting portion 78 of the cap member 15, positive charge on the surface of the electrode member 79 increases because of electrostatic induction.

Thus, because of the induced voltage generated by the electrostatic induction, the voltage between the nozzle substrate 43 and the electrode member 79 becomes higher than the initial voltage in a state in which the ink droplet D is not discharged.

Then, as shown in FIG. 5B, when the ink droplet D lands on the electrode member 79, the positive charge of the electrode member 79 is neutralized by the negative charge of the ink droplet D. Thus, the voltage between the nozzle substrate 43 and the electrode member 79 becomes lower than the initial voltage.

Thereafter, the voltage between the nozzle substrate 43 and the electrode member 79 returns to the initial voltage.

Accordingly, as shown in FIG. 6, the detection waveform output from the ink droplet sensor 7 has a waveform in which the voltage first increases, then decreases below the initial voltage, and returns to the initial voltage.

In this manner, changes in voltage during discharge of the ink droplets D from the nozzles 47 are detected by the ink droplet sensor 7.

However, for example, when the ink droplets D are viscous, even if the same discharge pulse DP is used, the discharge amount (liquid amount) is small compared to the normal situation. Therefore, as shown with a solid line in FIG. 6, the amplitude A of the detection signal (detection waveform Z) output from the ink droplet sensor 7 is smaller than the amplitude A0 corresponding to the detection signal in the normal situation (ideal waveform Z0: dashed line in FIG. 6) (amplitude difference ΔA). In addition, the time from when the discharge pulse DP is applied to when the ink droplets D depart from the nozzle substrate 43 is longer than that in the normal situation (the voltage-rise timing is delayed by the time difference ΔT).

Accordingly, by comparing the amplitude A and voltage-rise timing of the detection waveform Z output from the ink droplet sensor 7 with those of the ideal waveform Z0 (that is, by detecting ΔA and ΔT), the viscosity of the ink L in the nozzles 47 of the recording head 3 can be known. Because viscous ink cannot be adequately discharged from the nozzles 47, such nozzles are regarded as defective nozzle. That is, as described above, the ink droplet sensor 7 can detect the ink ejection status of the nozzles 47 (that is, can determine whether the nozzle is defective or not). Also in the ink droplet sensor 7, the processing unit 82 determines the cleaning parameters according to the detection result. In this embodiment, the drive conditions of the suction mechanism 15*d* during the suction operation as cleaning are used as the cleaning parameters.

The use of this ink droplet sensor 7 enables to acquire accurate ink discharge status, i.e., whether each of the nozzles 47 can adequately discharge ink or not. Thus, the processing parameters during cleaning can be determined according to the accurate detection result, and the problem that fluid is sucked from the ejection nozzles more than necessary during cleaning can be prevented.

Although the example in which the ink droplet sensor 7 detects the viscous ink has been described, the invention is not limited thereto. For example, if ink containing bubbles is discharged from the nozzles 47, a waveform different from that in the case of discharge of normal ink is output. Therefore, the ink droplet sensor 7 can detect the nozzles 47 discharging ink containing bubbles as defective nozzles. When highly viscous ink clogs the nozzles 47 and ink is not discharged from the nozzles 47 during examination, no waveform is detected. Thus, the ink droplet sensor 7 can also detect the nozzles 47 suffering from discharge failure.

Figure 7:
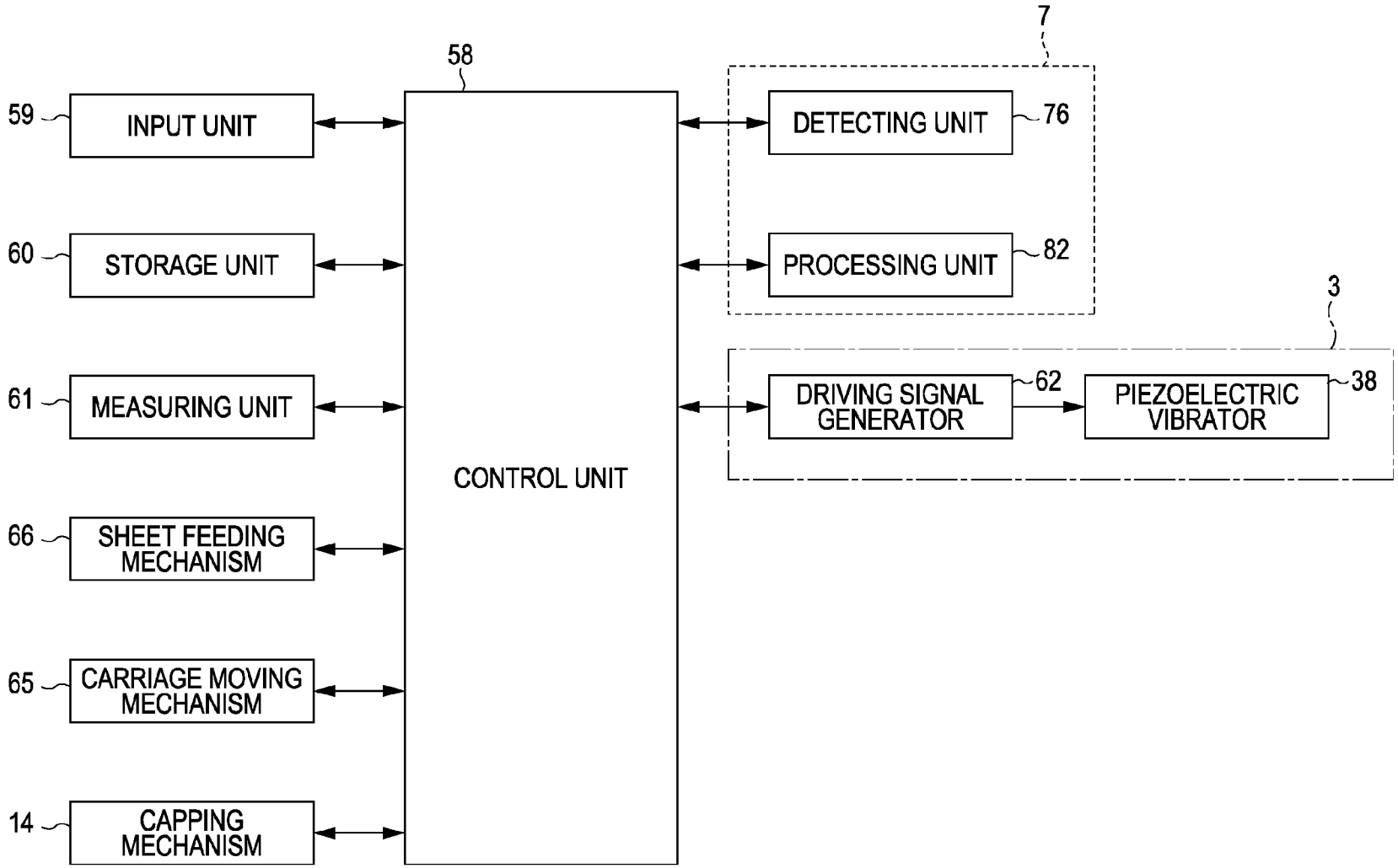
FIG. 7 is a block diagram showing an electrical configuration of the printer.
Figure 8:
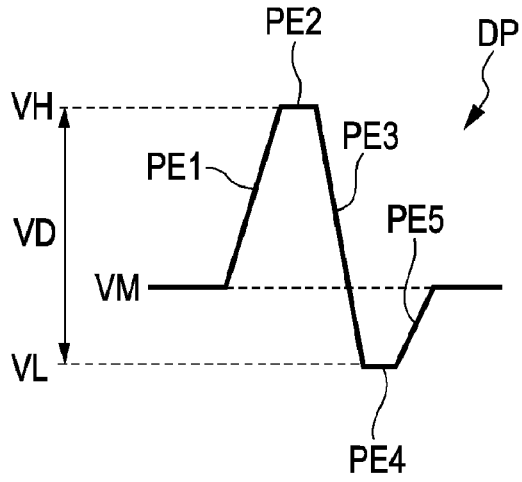
FIG. 8 is a diagram showing a discharge pulse.

FIG. 7 is a block diagram showing an electrical configuration of the printer 1 and FIG. 8 is a diagram showing a discharge pulse. The printer 1 according to this embodiment has a control unit 58 for controlling the operation of the entire printer 1. The control unit 58 is connected to an input unit 59 for inputting various information related to the operation of the printer 1, a storage unit 60 in which the various information related to the operation of the printer 1 is stored, and a measuring unit 61 capable of measuring the time.

The control unit 58 is connected to the sheet feeding mechanism 66, the carriage moving mechanism 65, the capping mechanism 14, the ink droplet sensor 7 (the voltage detector 81 and the processing unit 82), and the like.

The printer 1 has a driving signal generator 62 that generates a driving signal to be input to the piezoelectric vibrators 38. The driving signal generator 62 is connected to the control unit 58.

Data showing variation of the voltage of the discharge pulse to be input to the piezoelectric vibrators 38 of the recording head 3 and a timing signal for determining the timing at which the voltage of the discharge pulse is changed are input to the driving signal generator 62. The driving signal generator 62 generates a driving signal containing the discharge pulse DP shown in FIG. 8, for example, according to the data and the timing signal input thereto.

In FIG. 8, the discharge pulse DP includes a first charging element PE1 that raises the potential at a predetermined gradient from a reference potential VM to a highest potential VH, a first holding element PE2 that maintains the highest potential VH for a certain time, a discharging element PE3 that lowers the potential from the highest potential VH to the lowest potential VL at a predetermined gradient, a second holding element PE4 that maintains the lowest potential VL for a short time, and a second charging element PE5 that brings the potential from the lowest potential VL back to the reference potential VM. A drive voltage VD, which is the potential difference between the highest potential VH and the lowest potential VL in the discharge pulse DP, is set such that the amount of ink droplets ejected from the nozzles 47 is equal to the design value. Note that the discharge pulse DP shown in FIG. 8 is an example and various waveforms are possible.

When the driving signal generator 62 inputs the discharge pulse DP to the piezoelectric vibrators 38, the ink droplets are discharged from the nozzles 47. When the first charging element PE1 is supplied, the piezoelectric vibrators 38 contract and the pressure chambers 46 expand. After the pressure chambers 46 are kept expanded for a short time, the discharging element PE3 is supplied to cause sudden expansion of the piezoelectric vibrators 38. As a result, the volume of the pressure chambers 46 contracts below the reference volume (the volume of the pressure chambers 46 when the reference potential VE is applied to the piezoelectric vibrators 38), and the menisci exposed on the nozzles 47 are rapidly pressurized outward. Thus, a predetermined amount of the ink droplets D is discharged from the nozzles 47. Then, the second holding element PE4 and the second charging element PE5 are sequentially supplied to the piezoelectric vibrators 38 to bring the pressure chambers 46 to the reference volume so that vibration of the menisci caused by the discharge of the ink droplets D is settled in a short time.

The operation of the printer 1 having the above-described configuration will be described below. The maintenance operation of the printer 1 will be mainly described.

Figure 11:
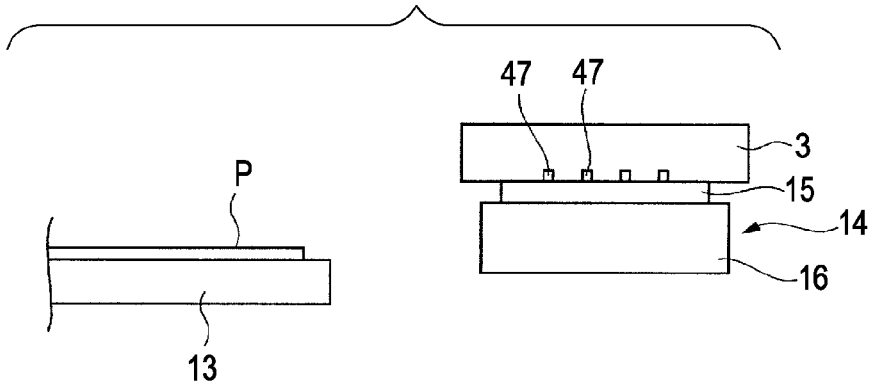
FIG. 11 is an operation diagram of the printer according to this embodiment.

First, the recording head 3 is moved to the maintenance position, and then, as shown in FIG. 11, the recording head 3 and the cap member 15 are brought into contact. Thus, the region enclosed by the cap member 15 and the recording head 3 is capped. In this state, the suction mechanism 15*d* is activated to applying suction and make the capped space have negative pressure. By making the capped space have negative pressure, the suction operation is performed.

Figure 12:
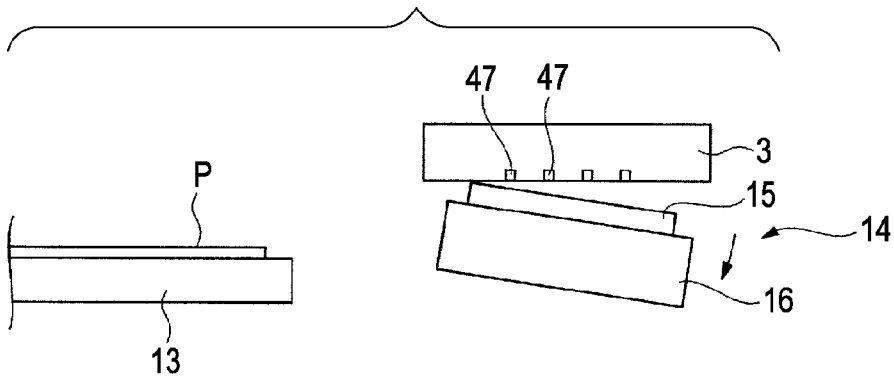
FIG. 12 is an operation diagram of the same.

After the suction operation, the space under negative pressure is opened to the atmosphere. When the space is opened to the atmosphere, as shown in FIG. 12, the supporting member 16 is tilted such that the end of the supporting member 16 farthest from the platen 13 is brought away from the recording head 3. The tilt allows a contact portion 15*a* of the cap member 15 to be opened to the atmosphere from the right side in FIG. 12, and more preferably, from one of the two corners on the right side in FIG. 12. After the space is opened to the atmosphere, the tilt of the supporting member 16 is maintained.

Figure 13:
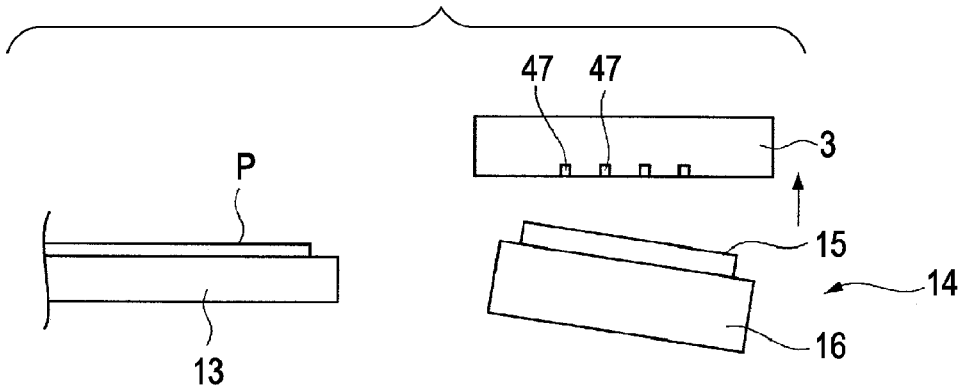
FIG. 13 is an operation diagram of the same.
Figure 14:
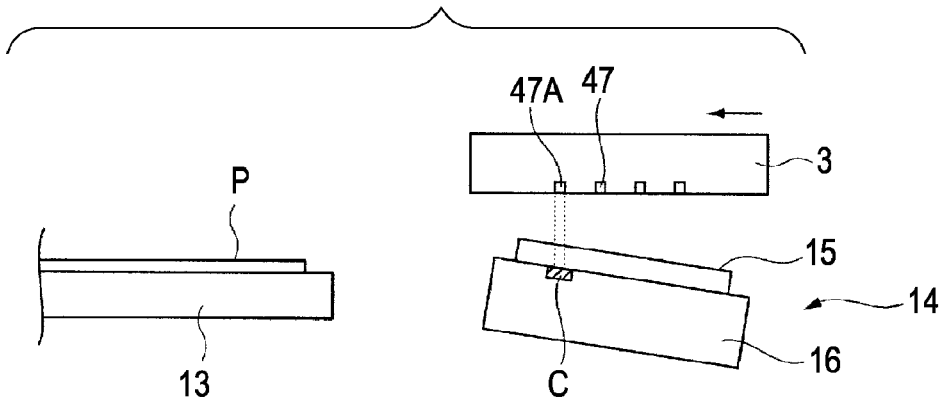
FIG. 14 is an operation diagram of the same.
Figure 15:
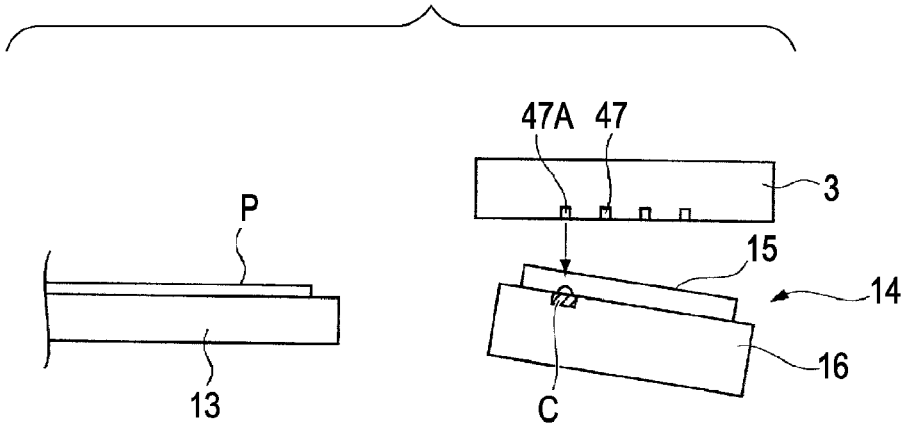
FIG. 15 is an operation diagram of the same.

After the capped state is terminated, the recording head 3 is lifted, as shown in FIG. 13, and a first portion 47A that is the nozzle row located most adjacent to the platen 13 is positioned such that it overlaps a predetermined region C on the cap member 15 in the plan view, as shown in FIG. 14. It is preferable that the predetermined region C be provided in a region where the electrode 79 is formed, and at a portion closest to the platen 13, that is, a portion most adjacent to the recording head 3. After positioning, as shown in FIG. 15, ink is ejected from the nozzle row at the first portion 47A toward the predetermined region C, and the potential difference from the recording head 3 is detected by the detection electrode 79.

Figure 16:
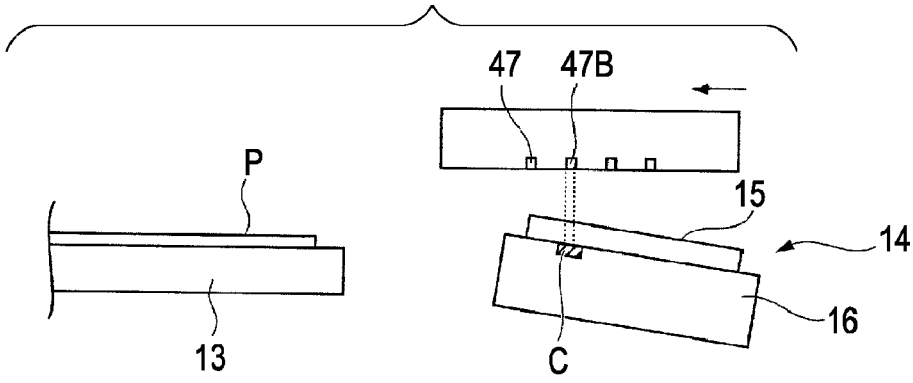
FIG. 16 is an operation diagram of the same.
Figure 17:
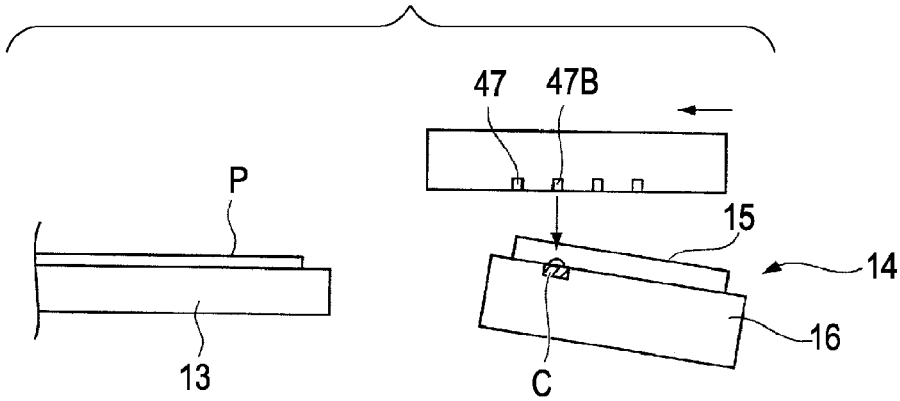
FIG. 17 is an operation diagram of the same.
Figure 18:
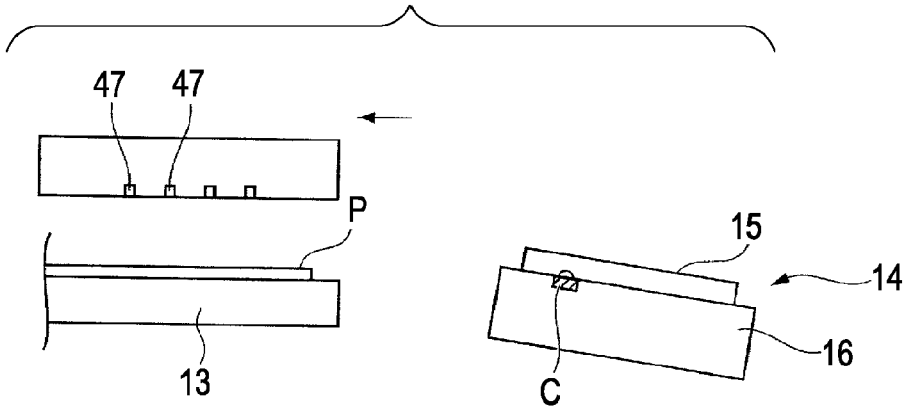
FIG. 18 is an operation diagram of the same.

After ejection of ink from the first portion 47A, the recording head 3 is moved toward the platen 13 and is positioned such that a second portion 47B provided behind the first portion 47A in the moving direction overlaps the predetermined region C in the plan view, as shown in FIG. 16. After positioning, as shown in FIG. 17, ink is ejected from the second portion 47B toward the predetermined region C, and the potential difference from the recording head 3 is detected by the detection electrode 79. After ink discharge from each nozzle row is sequentially performed, as show in FIG. 18, the recording head 3 is moved to a position above the platen 13. Then, ink is ejected toward a recording medium P disposed on the platen 13.

As has been described, first, while the cap member 15 is tilted such that the rear side thereof in the moving direction of the recording head 3 is relatively far from the recording head 3, ink is ejected from the first portion 47A toward the predetermined region C. Then, the recording head 3 is moved in the moving direction and the second portion 47B provided behind the first portion 47A in the moving direction is positioned at a position overlapping the predetermined region C in the plan view, and ink is ejected from the second portion 47B toward the predetermined region C. Thus, the distance between the first portion 47A that ejects ink and the predetermined region C on the cap member 15 and the distance between the second portion 47B that performs subsequent ejection and the predetermined region C on the cap member 15 are equal. Accordingly, even if the facing portion of the cap member 15 is tilted, the potential difference can be measured more accurately. Thus, precise detection of a missing dot of the recording head 3 becomes possible.

The technical scope of the invention is not limited to the above-described embodiment, and it can be modified within the scope not departing from the gist of the invention.

In the above-described embodiment, the first portion 47A and the second portion 47B each correspond to one of the rows of the nozzles 47. However, the invention is not limited to such a configuration, and, for example, the first portion 47A and the second portion 47B may each correspond to two rows of the nozzles 47. Such a configuration enables measurement of the potential difference for a plurality of nozzle rows with a single movement. Thus, the maintenance efficiency can be improved.

Although an ink jet recording apparatus has been described as an example in the above-described embodiment, the invention is not limited thereto. The invention may also be used to perform microprocessing in a field other than the printing technology field, for example, in fabrication of a specific medium (display color filter, etc.).

What is claimed is:

1. A maintenance method of a fluid ejecting apparatus having an ejection head that is movable in a predetermined direction and ejects fluid onto a medium; a cap member that faces an ejection region of the ejection head, a portion facing the ejection region being tiltable with respect to the ejection head, and that comes into contact with an ejection surface of the ejection head for ejecting fluid so as to cover the ejection surface; and a potential difference detection unit that detects a potential difference between the cap member and the ejection head, the maintenance method comprising:

when a capped state, in which a space including the election surface is covered by the cap member, is to be terminated, terminating the capped state from a part of the cap member by tilting the facing portion of the cap member with respect to the ejection head;

after termination of the capped state, ejecting fluid from a first portion of the ejection region toward a predetermined region of the facing portion and detecting the potential difference resulting from the ejection of the fluid from the ejection head;

after ejection of the fluid from the first portion, moving the ejection head in the predetermined direction and positioning a second portion of the ejection region provided behind the first portion of the ejection region in the predetermined direction at a position overlapping the predetermined region in a plan view;

after movement of the ejection head, ejecting fluid from the second portion toward the predetermined region; and detecting the potential difference resulting from the ejection of the fluid from the ejection head.

2. The maintenance method of a fluid ejecting apparatus according to claim 1, wherein the medium is disposed in the predetermined direction of the ejection head with respect to the cap member.

3. The maintenance method of a fluid ejecting apparatus according to claim 1, wherein a plurality of nozzles for ejecting fluid are provided in the ejection region; and the plurality of nozzles are arranged in a direction perpendicular to the predetermined direction of the ejection head.

4. The maintenance method of a fluid ejecting apparatus according to claim 3, wherein a plurality of rows of the nozzles are provided at the first portion.

5. The maintenance method of a fluid ejecting apparatus according to claim 1, wherein, when the capped state is terminated, the facing portion is tilted such that an anterior side of the facing portion of the cap member in the predetermined direction of the ejection head is closer to the ejection head.

* * * * *